US005699738A

United States Patent [19]

Corrado et al.

[11] Patent Number: 5,699,738

[45] Date of Patent: Dec. 23, 1997

[54] APPARATUS AND METHOD FOR CLEANING A ROLLER

[75] Inventors: Frank C. Corrado; James W. Fischer, both of Rochester; Gary R. Larsen, Webster; Ronald W. Sweet, New York, all of N.Y.

[73] Assignee: Seratek LLC, Levonia Center, N.Y.

[21] Appl. No.: 667,177

[22] Filed: Jun. 20, 1996

Related U.S. Application Data

[63] Continuation-in-part of Ser. No. 439,063, May 8, 1995, Pat. No. 5,611,281.

[51] Int. Cl.[6] ..... B41F 35/00

[52] U.S. Cl. ..... 101/425; 101/423

[58] Field of Search ..... 101/424, 425, 101/423; 15/256.53, 256.52, 256.51, 256.5

[56] References Cited

U.S. PATENT DOCUMENTS

| | | | |
|---|---|---|---|
| 4,765,242 | 8/1988 | Oya et al. | 101/425 |
| 4,953,252 | 9/1990 | Akisawa | 101/425 |
| 4,982,469 | 1/1991 | Nishiwaki | 15/3 |
| 5,251,348 | 10/1993 | Corrado et al. | 15/256.53 |
| 5,275,104 | 1/1994 | Corrado et al. | 101/425 |
| 5,373,789 | 12/1994 | Waizmann | 101/425 |
| 5,379,695 | 1/1995 | Rieth et al. | 101/424 |
| 5,425,813 | 6/1995 | Ernst et al. | 101/256.5 |
| 5,519,914 | 5/1996 | Egan | 15/256.53 |
| 5,524,805 | 6/1996 | Shiba et al. | 101/425 |

*Primary Examiner*—Edgar S. Burr
*Assistant Examiner*—Anthony H. Nguyen
*Attorney, Agent, or Firm*—M. Lukacher

[57] ABSTRACT

A cleaning system for removing contaminants from the surface of a roller. A stationary cleaning pad is forced at a first urging force against a roller to be cleaned, and the roller is driven in rubbing contact with the pad. Preferably, the pad is supplied continuously with a cleaning liquid. An actuator disposed against a portion of the back of the pad urges that portion against the roller at a second, greater urging force to accelerate the rate of cleaning. A control loop between the roller motor drive and the actuator responds to a signal from the drive indicative of the magnitude of frictional resistance between the roller and the pad and increases or decreases the second force furnished by the actuator to provide a predetermined constant frictional resistance during cleaning. If flow of cleaning liquid to the pad is lost, friction can build up quickly and the roller surface can become damaged. The system safeguards the roller surface by reducing the actuator force to counter frictional increase and by terminating the cleaning cycle and alarming the condition when the limit of controller action is reached.

19 Claims, 4 Drawing Sheets

APPARATUS AND METHOD FOR CLEANING A ROLLER

DESCRIPTION

This application is a continuation-in-part of our application, Ser. No. 08/439,063 filed May 8, 1995 now matured as U.S. Pat. No. 5,611,281 issued Mar. 18, 1997.

The present invention relates to systems (apparatus and methods) for removing contaminants from process rollers and more particularly to apparatus and methods for washing and scrubbing contaminants from process rollers, and most particularly to apparatus and methods for removing accumulated particles from contact cleaning rollers.

Process rollers are well known in the manufacturing arts for conveying and transforming substrates, especially flexible linear substrates such as film and paper supports known generically as webs. Rollers may be used, for example, to convey, steer, tension, smooth, compress, print, and clean substrates in, for example, film and paper coating machines, rotary printing presses, and high-pressure calendaring machines.

A common problem with all such rollers is that they eventually accumulate contaminants, especially foreign particles, on their surfaces, which can cause unwanted physical and/or chemical anomalies in the substrates and in coatings thereupon. All such process rollers, therefore, require cleaning of their surfaces from time to time. The problem is particularly acute for contact cleaning rollers (CCRs) which are intended by their very nature to become clogged on their surfaces as they remove particles from the surfaces of substrates over which the CCRs have been rolled, and which must be renewed by cleaning in order to restore their particle-removing effectiveness.

In the process roller cleaning apparatus of the above referenced parent application Ser. No. 08/439,063 a stationary cleaning pad is brought into rubbing contact with the contaminated surface of a roller being driven. The pad may be dry or, typically, it may be moistened with a suitable liquid to aid in dislodging or dissolving the contaminants on the roller surface. Such apparatus is shown in FIGS. 1 and 2 and discussed more fully hereinafter. Rubbing or scrubbing of the cleaning pad against the roller causes contaminants to be transferred to the cleaning pad. The pad may consist of a cleaning web in contact with the roller surface, supported by a backing element such as a sponge to urge the cleaning web against the roller. The cleaning web may be intermittently or continuously dispensed from an unsoiled source to present clean web to the roller, the soiled web being accumulated out of contact with the roller. The pad also may move axially of the roller during cleaning so that a pad substantially narrower than the roller can progressively clean the entire roller surface. See U.S. Pat. Nos. 4,982,469 to Nishiwaki and 5,251,348 to Corrado for other apparatus for cleaning process rollers.

At least two problems can arise in existing apparatus for cleaning process rollers. First, the force with which the cleaning pad is urged against the roller is distributed over the entire surface area of the pad, so that the unit pressure at any point on the pad may be quite low, which can result in slow and incomplete cleaning of the roller surface. Thus, a need exists for means for increasing locally the force exerted on a portion of a cleaning pad. Second, cleaning systems employing liquids typically rely for cooling and lubrication on the liquids themselves, and if flow of liquid to the cleaning pad is lost, the dry pad can rapidly damage or destroy the delicate surface of the roller being cleaned. Thus, a need exists for means for monitoring and controlling the proper rubbing action of a cleaning pad against a roller and for providing an out-of-control alarm.

It is a principal object of the invention to provide improved systems for cleaning process rollers which increase locally, selectively, and automatically the force exerted on a cleaning pad in rubbing contact with a roller surface.

It is a further object of the invention to provide such systems which also serves to monitor and control the force being exerted by a cleaning pad against a roller surface.

It is a still further object of the invention to provide such systems and which also operates alarm the system when the frictional resistance of a cleaning pad against a roller surface exceeds predetermined control limits.

Briefly described, a roller cleaning system embodying the invention comprises a cleaning pad which may be urged selectively against the surface of a rotating roller to be cleaned. The roller may be rotated by any convenient drive means from which a drive signal may be extracted, including an electric motor, an internal combustion engine, an hydraulic motor, and an air motor. The cleaning pad may include a backing sponge and a cleaning web between the sponge and the roller surface. The system may include a reservoir or other source of cleaning fluid, such as water or solvent, to moisten, cool, and lubricate the pad during rubbing or scrubbing against the roller, and to loosen or dissolve the contaminants being removed. The unsoiled cleaning web may be dispensed as from a feed roll of material, and the soiled web may be wound on a takeup roll. The components are mounted on a suitable frame or housing, which may be translatable axially of the roller during cleaning.

To initiate rubbing contact between the cleaning pad and the roller surface, either the roller is urged with a first force against the cleaning pad, as in the references cited previously, or the pad may be urged against the roller.

An actuator is disposed between the frame and a portion of the back side of the cleaning pad to selectively exert a second and higher force against the portion of the cleaning pad and hence against the roller in a localized area of higher pad pressure to accelerate removal of more firmly adhered contaminants.

In a preferred embodiment of the invention, a control loop is included between the roller drive and the actuator. A controller senses continuously a drive signal from the roller drive indicative of the magnitude of frictional resistance between the roller and the cleaning pad and adjusts continuously the force exerted by the actuator on the cleaning pad to maintain a constant frictional resistance. The system alarms when predetermined control limits are exceeded. Other values of frictional resistance can be achieved if desired by programming the controller to vary the second force exerted by the actuator.

A roller cleaning system in accordance with the invention is especially useful in "renewing" (cleaning) contaminant-loaded contact cleaning rollers, known in abbreviation as CCRs.

The foregoing and other objects, features, and advantages of the invention, as well as presently preferred embodiments thereof, will become more apparent from a reading of the following description in connection with the accompanying drawings in which.

Figure 1:
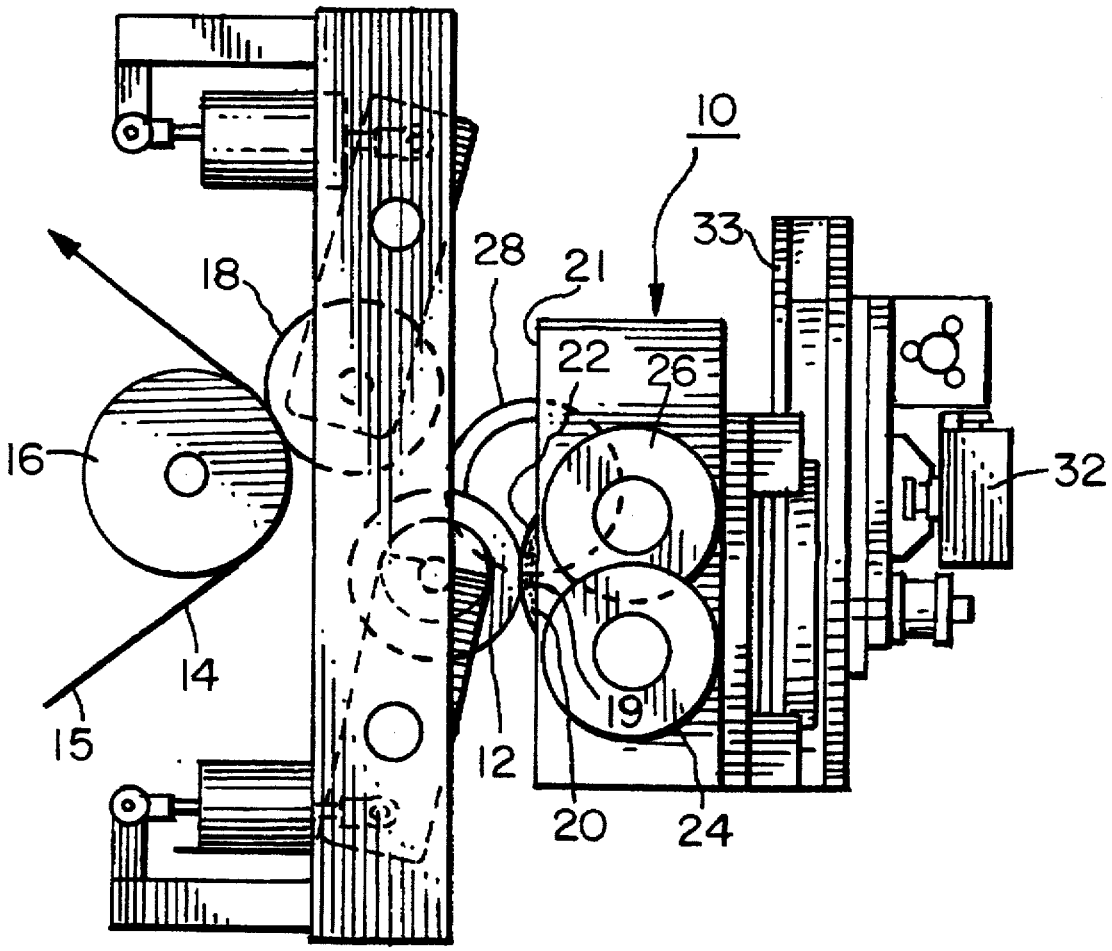
FIG. 1 is an elevational view in cross-section of an existing roller cleaning system, taken along line 1—1 in FIG. 2.
Figure 2:
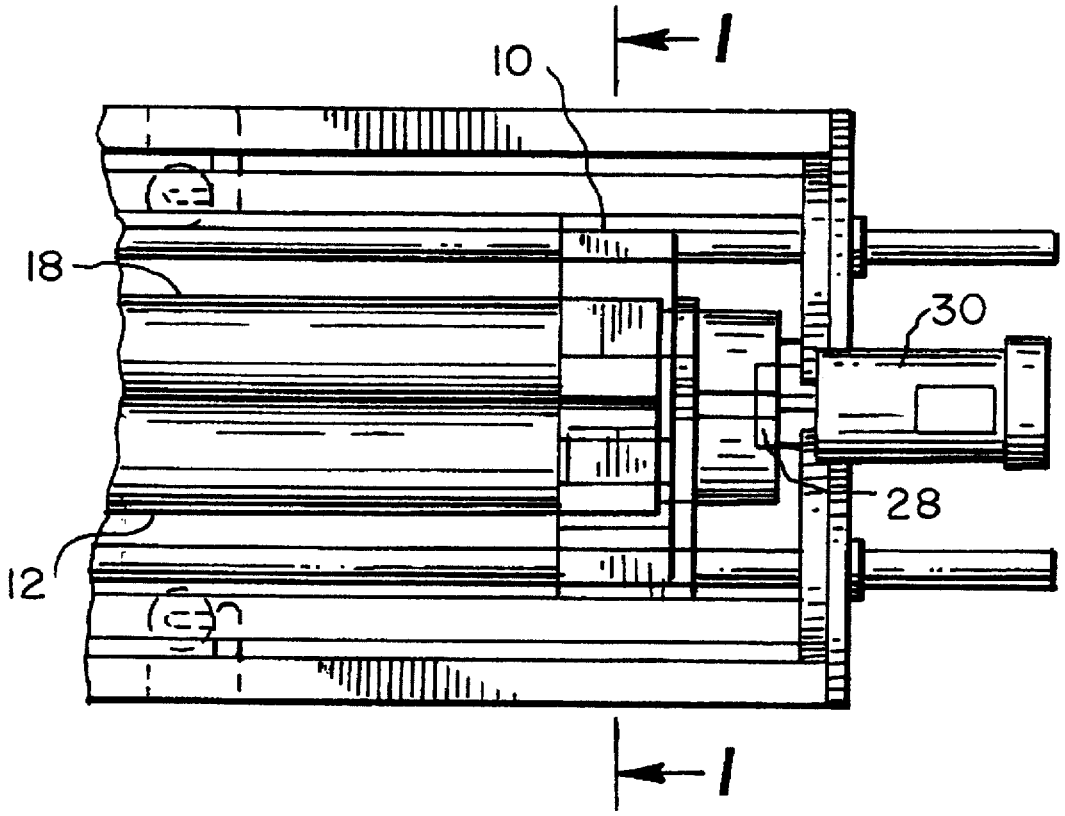
FIG. 2 is an elevational view of the existing roller cleaning system shown in FIG. 1.

Referring to FIGS. 1 and 2, existing roller cleaning apparatus 10 is shown in position to clean, or "renew," by rubbing a first contact cleaning roller 12, which roller has been pivoted out of cleaning contact with surface 14 of web 15 being conveyed around process conveyance roller 16. Second contact cleaning roller 18 is in position to clean surface 14. Roller cleaning apparatus 14 includes a cleaning pad 19 supported on a frame 21 preferably having a backing element 20 and a cleaning web 22 although other cleaning pad configurations may be used. Backing element 20 may be any suitable resilient material, preferably a sponge or sponge cartridge, and operates to urge cleaning web 22 against roller 12 at a substantially uniform pressure over the entire surface of element 20. Cleaning web 22 may be any suitable web, preferably a non-shedding cloth material impregnated with an agent to aid in removing particulates from contact cleaning rollers 12 and 18. Preferably, cleaning web 22 is continuously wetted at the contact point with roller 12 with liquid from a reservoir (not shown) included in apparatus 10. Cleaning web 22 is dispensed intermittently or continuously from a feed roll 24 of material and is accumulated on a take-up roller 26 when soiled.

Contact cleaning roller 12 is driven in rubbing contact past cleaning pad 19 by friction drive wheel 28 which is mounted on a shaft of drive motor 30. Preferably, roller 12 is driven at a fixed speed experimentally predetermined to yield adequate cleaning of roller 12 in a desired length of time. Apparatus 10 is mounted on a horizontal track and rails 32 and preferably is driven axially of roller 12 in an oscillatory or reciprocating motion so that pad 19 progressively cleans the entire surface of roller 12. Apparatus 10 also includes vertical rails 33 to permit the cleaning apparatus to be elevated to a second position appropriate for renewing roller 18 when it is pivoted into its renewal position.

Figure 3:
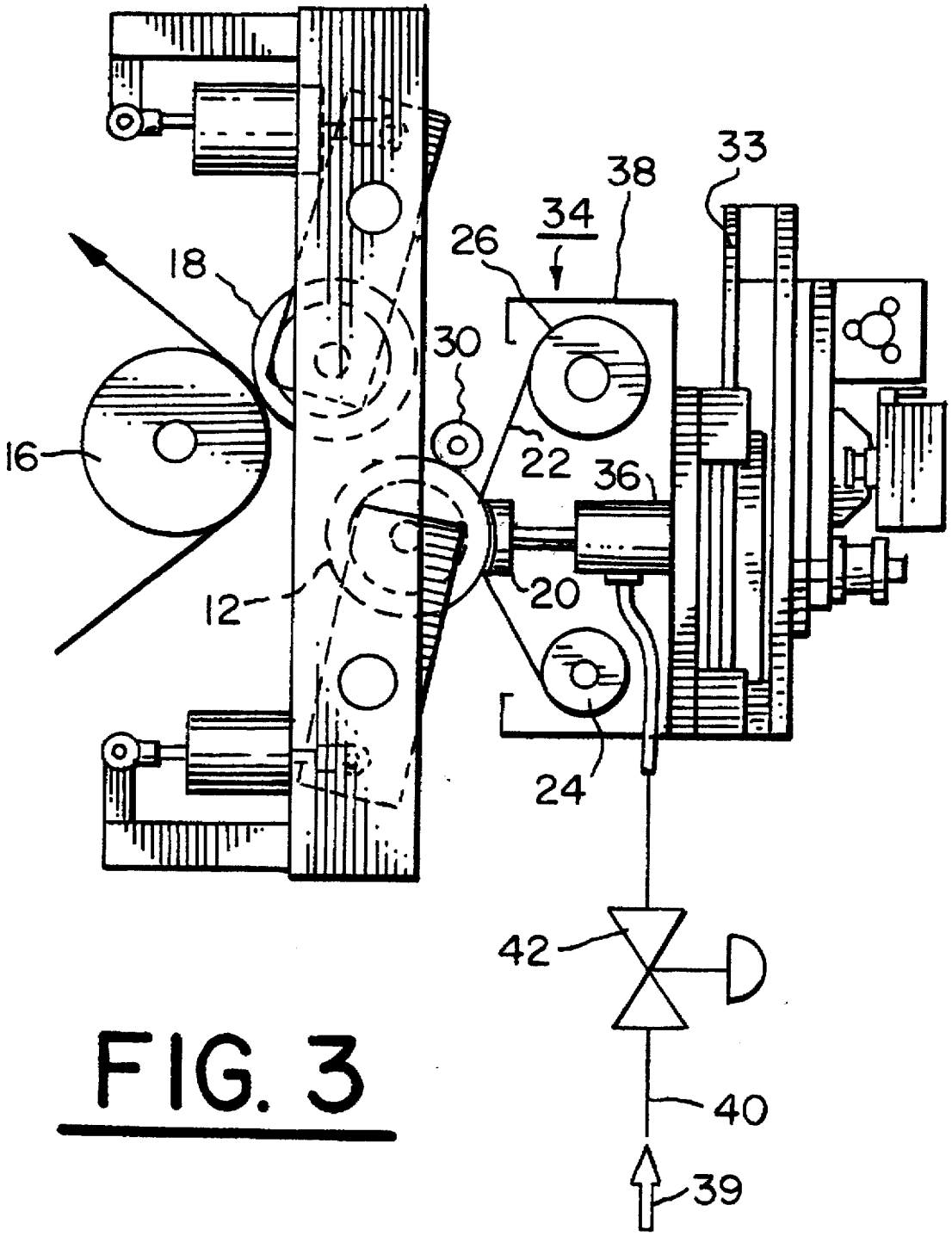
FIG. 3 is a view like that of FIG. 1, showing a roller cleaning system having a cleaning pad high-pressure actuator in accordance with the subject invention.

In some applications, the existing apparatus can remove deposits from the cleaning roller only very slowly and incompletely. We have found that an unexpected and dramatic improvement in cleaning rate and thoroughness can be achieved if a portion, preferably a central portion, of cleaning pad 19 is urged selectively against the cleaning roller with a second rubbing force substantially greater than the first force existing over the rest of the pad. FIG. 3 shows roller cleaning system 34 in accordance with the invention. An actuator 36 is disposed between the back side of backing element 20 and housing 38 and between feed and take-up rollers 24 and 26, respectively. Actuator 36, shown as preferred, is a pneumatic cylinder supplied with pressurized air from a high-pressure source 39 through supply line 40 and a reducing valve 42, by which the selectively greater force on backing element 20 can be set. Alternatively, actuator 36 may be any convenient, variable source of selectively increased force against a portion of pad 22, for example, a hydraulic cylinder or a stepper motor. Other means of variable actuation which may come to mind are within the scope of the invention.

In general, it is most desirable to clean a roller in the shortest time possible, consistent with thorough cleaning and without damage to the roller surface. This may require that the second force be quite large, and cleaning liquid generally is necessary in the contact area to cool and lubricate the roller surface and the cleaning web, as well as to loosen and dissolve particles on the dirty roller and to aid in their transfer to the cleaning web. If flow of liquid to the contact area is lost, for example, if the reservoir is not timely replenished, increasing friction from dry rubbing can lead rapidly to damage and destruction of the roller surface and even to combustion of the cleaning web. Thus, it is also highly desirable to have control means in the roller cleaning system for sensing an out-of-control condition, for preventing damage to the roller and the system, and for alarming any potentially dangerous condition.

Figure 4:
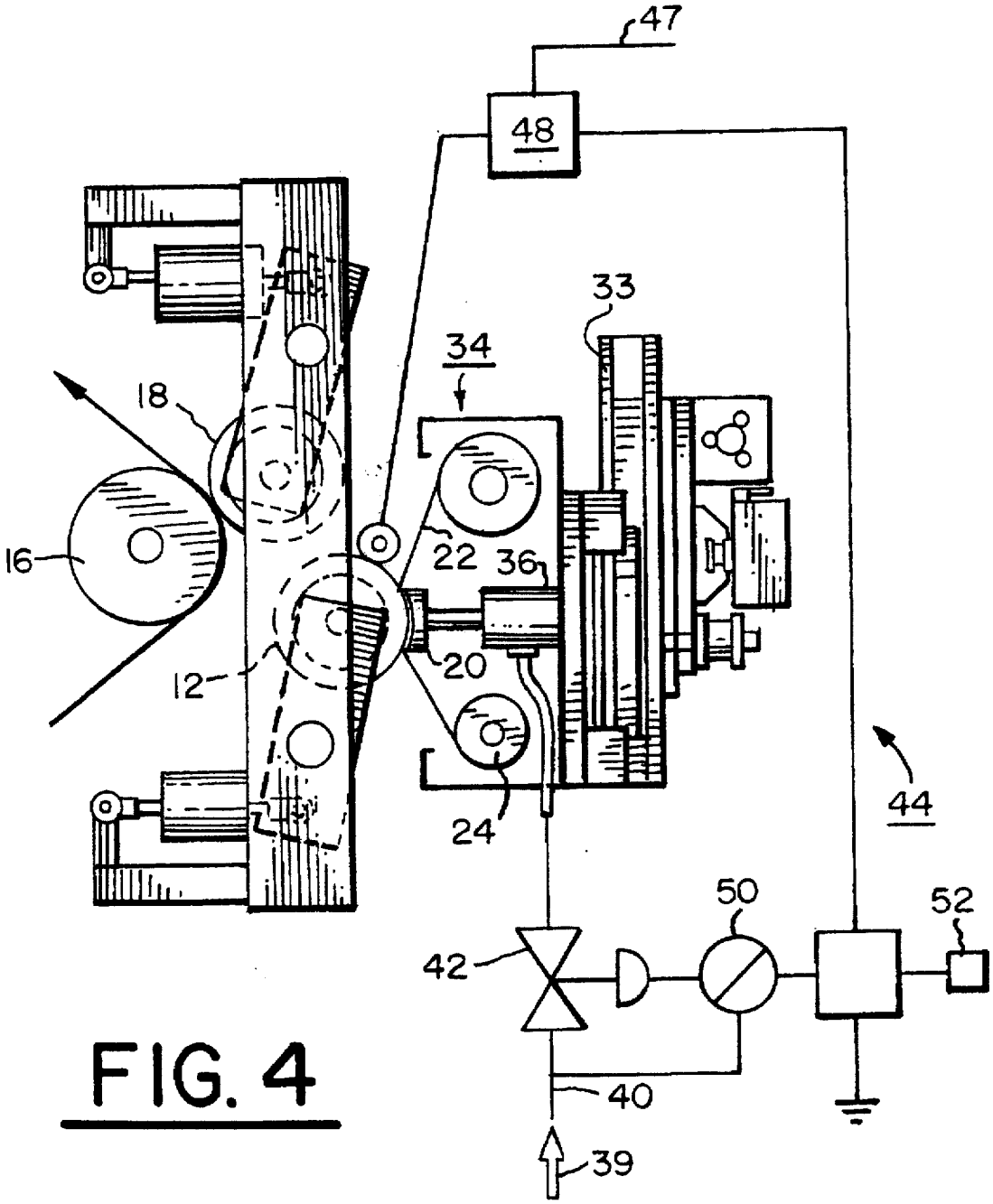
FIG. 4 is a view like that of FIG. 3, showing a roller cleaning system having a schematic control loop for controlling the pressure exerted by a cleaning pad high-pressure actuator.

FIG. 4 shows a control loop 44 added to the novel roller cleaning system 34 of FIG. 3. An electronic controller 46 senses a signal from a conventional electronic drive package 48 which controls roller drive motor 30. The current 47 drawn by motor 30 is a useful signal indicative of the magnitude of frictional resistance between roller 12 and cleaning web 22, the level of which current is desirably held constant during a roller cleaning cycle. The correct controller set point for this desired current level is determined experimentally. Controller 46 outputs through a conventional current/pressure transformer 50 to vary the opening of reducing valve 42 to increase or decrease the force exerted by actuator 36 on backing element 20 and thereby to maintain as constant the amperage drawn by drive motor 30. Of course, the controller may be programmed to increase or decrease the force as desired, for example, additional force may be beneficial in areas of the roller known to be more heavily loaded with particles.

If the cleaning area becomes dry and frictional resistance begins to increase, the motor load begins to increase, and the controller instantly and automatically reduces the second force on the cleaning pad. If the motor load continues to increase, the controller will continue to decrease the second force. Preferably, an alarm limit is established within or at the limit of controller action, at which point the system presents an alarm condition and activates alarm 52. Preferably, cleaning of the roller is automatically terminated at the alarm, either by separating the roller from the cleaning pad or by shutting down the roller drive, or both.

In an alternative embodiment, drive motor 30 may be such that increased frictional load results in a decrease in motor speed, for example, an air motor or an hydraulic motor. In such case, the control scheme can utilize the rotational speed of the motor as the set point for the controller. The action of the controller and the alarm is the same as above.

From the foregoing description it will be apparent that there has been provided an improved apparatus and method for cleaning rollers, wherein a programmed higher cleaning force is locally exerted on a cleaning pad to improve the effectiveness of cleaning. Variations and modifications of the herein described roller cleaning system, in accordance with the invention, will undoubtedly suggest themselves to those skilled in this art. Accordingly, the foregoing description should be taken as illustrative and not in a limiting sense.

What is claimed is:

1. A system for cleaning contamination from the surface of a roller, comprising:

a first frame, a second frame, a cleaning pad mounted on said first frame adjacent to said roller, said roller being rotatably mounted on said second frame, at least one of said first and second frames being movable toward the other to urge said cleaning pad into rubbing contact with said surface of said roller such that a first force is applied by said pad against said roller;

a drive operatively connected to said roller for turning said roller surface past said cleaning pad when said pad is in rubbing contact with said roller surface; and an actuator disposed against a portion of said cleaning pad and actuable in the direction of said roller for urging said portion of said cleaning pad against said roller at a second force, said portion of said cleaning pad being less than the whole of said pad, said second force acting in addition to said first force locally over said portion of said pad.

2. A system in accordance with claim 1 wherein said cleaning pad includes a cleaning web disposable against said roller and a backing sponge for supporting said cleaning web.

3. A system in accordance with claim 2 further comprising a dispenser providing unsoiled cleaning web and accumulating soiled cleaning web.

4. A system in accordance with claim 2 wherein said backing sponge is a sponge cartridge.

5. A system in accordance with claim 1 further comprising a carrier displacable with said cleaning pad axially of said roller.

6. A system in accordance with claim 5 wherein means are provided for oscillatory axial displacement of said carrier and cleaning pad.

7. A system in accordance with claim 1 wherein said actuator is selected from the group consisting of a hydraulic cylinder, a pneumatic cylinder, and a stepper motor.

8. A system in accordance with claim 1 wherein said roller is a contact cleaning roller.

9. A system in accordance with claim 1 wherein said cleaning pad is moist with a liquid during said rubbing contact with said roller.

10. A system in accordance with claim 1 wherein said drive means is selected from the group consisting of electric motor, internal combustion engine, hydraulic motor, and air motor.

11. A system in accordance with claim 1 further comprising a control loop operatively connecting said drive and said actuator, said drive further being capable of generating an output signal indicative of the magnitude of frictional resistance between said roller and said cleaning pad, said actuator further being variably responsive to variations in an input signal thereto to vary said second urging force of said pad against said roller, and said control loop being responsive to said drive output signal to generate said variable input signal to said actuator in accordance with a pre-determined program to control said frictional resistance between said roller and said cleaning pad.

12. A system in accordance with claim 11 wherein said drive includes an electric motor and an electronic circuitry for regulating the flow of electricity to said motor and for sending said electrical drive output signal to said control loop.

13. A system in accordance with claim 11 wherein said drive output signal is the current drawn by said motor.

14. A system in accordance with claim 11 wherein said drive output signal is the speed of rotation of said motor.

15. A system in accordance with claim 11 wherein said control loop includes a controller responsive to said drive signal and programmable to provide an inversely proportional controller output signal to said actuator.

16. A system in accordance with claim 11 wherein said control loop programmable to keep said drive output signal at a substantially constant value during said cleaning of said roller and to terminate said cleaning when the control limit of said control loop is exceeded.

17. A system in accordance with claim 14 further comprising an alarm which is actuable when said control limit is exceeded.

18. A method for cleaning contamination from the surface of a roller, comprising the steps of:

a) providing a cleaning pad in rubbing contact at a first force against said surface of said roller;

b) rotating said roller past said cleaning pad;

c) urging a portion of said cleaning pad against said roller surface with a second urging force; and d) controllably varying said second urging force to control the frictional resistance between said roller and said cleaning pad.

19. A method in accordance with claim 18 wherein said cleaning pad is moved axially of said roller during said rotating, urging, and varying steps.

* * * * *